United States Patent [19]

Sarkisian

[11] 4,041,632

[45] Aug. 16, 1977

[54] ART FRAME

[76] Inventor: Robert Sarkisian, 4276 Stoneleigh Road, Bloomfield Hills, Mich. 48013

[21] Appl. No.: 660,703

[22] Filed: Feb. 23, 1976

[51] Int. Cl.[2] ..... G09F 1/12

[52] U.S. Cl. ..... 40/156

[58] Field of Search ..... 403/231; 52/753 D, 758 H; 40/152, 155, 156

[56] References Cited

U.S. PATENT DOCUMENTS

| | | | |
|---|---|---|---|
| 481,117 | 8/1892 | Naegele | 40/156 |
| 1,470,866 | 10/1932 | Newhouse | 40/156 |
| 2,450,330 | 9/1948 | De Giers | 40/156 X |
| 2,581,843 | 1/1952 | Edwards | 40/155 |
| 3,314,181 | 4/1967 | Bauer | 40/156 X |
| 3,596,392 | 8/1971 | Vani | 40/156 |
| 3,665,629 | 5/1972 | Shore | 40/156 |
| 3,899,844 | 8/1975 | Munn | 40/156 |

FOREIGN PATENT DOCUMENTS

| | | | |
|---|---|---|---|
| 614,079 | 12/1960 | Italy | 40/152 |

*Primary Examiner*—Louis G. Mancene
*Assistant Examiner*—Wenceslao J. Contreras
*Attorney, Agent, or Firm*—Harness, Dickey & Pierce

[57] ABSTRACT

An improved art frame having a plurality of frame sections secured together by spring clips is disclosed. Brace members are positioned at the corners of the frame for additional strength and stability. A plurality of spring members each having at least one biased arm are positioned on the inside of the frame and releaseably hold the contents thereof in position. The frame is adapted to hold display and art materials of various sizes and thicknesses and to allow such materials to be easily and quickly inserted and removed.

13 Claims, 7 Drawing Figures

FIG. 1.
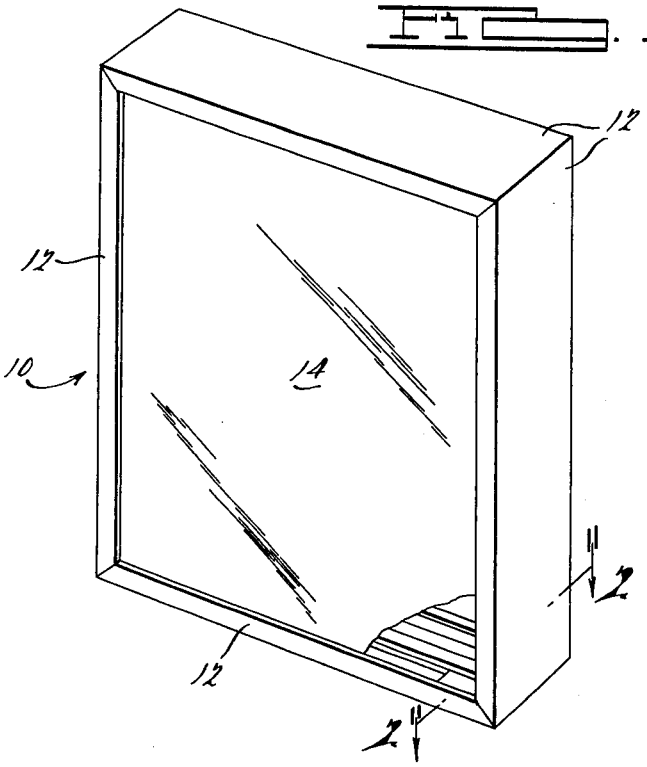
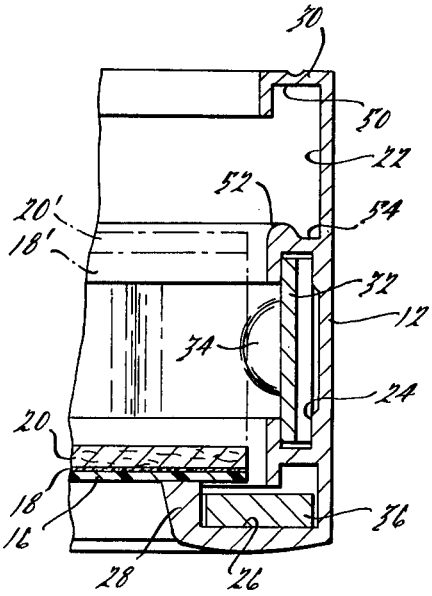
FIG. 2.
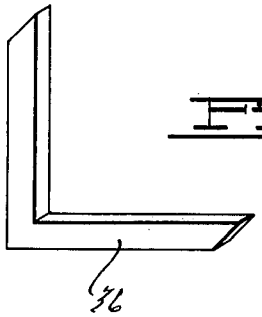
FIG. 3.
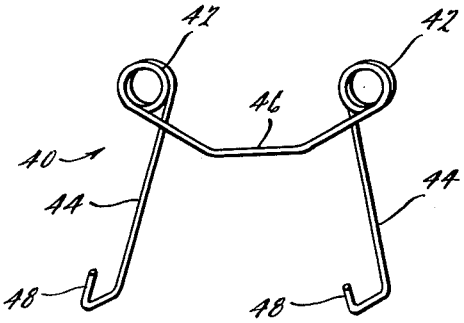
FIG. 5.
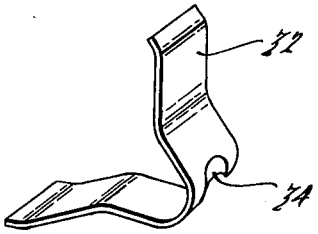
FIG. 4.

FIG. 6.
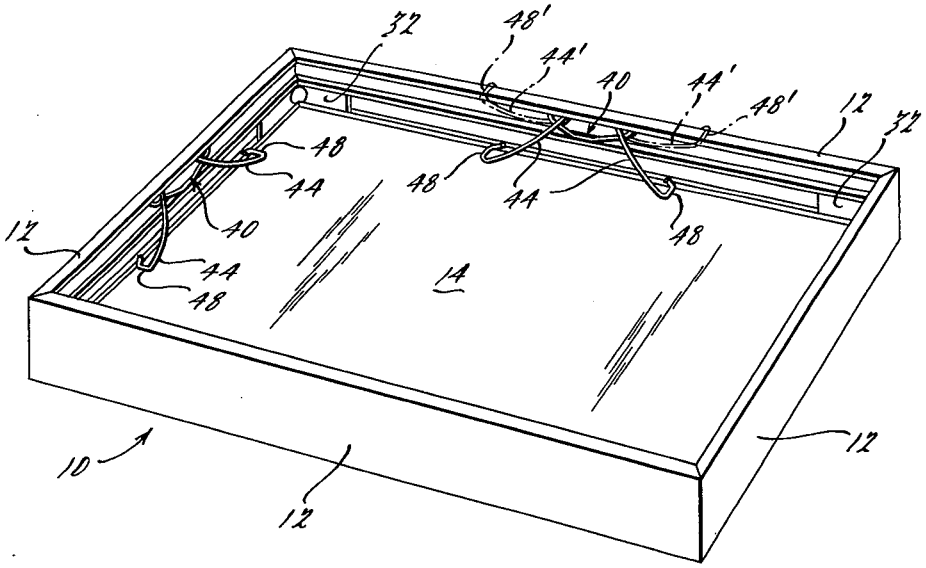
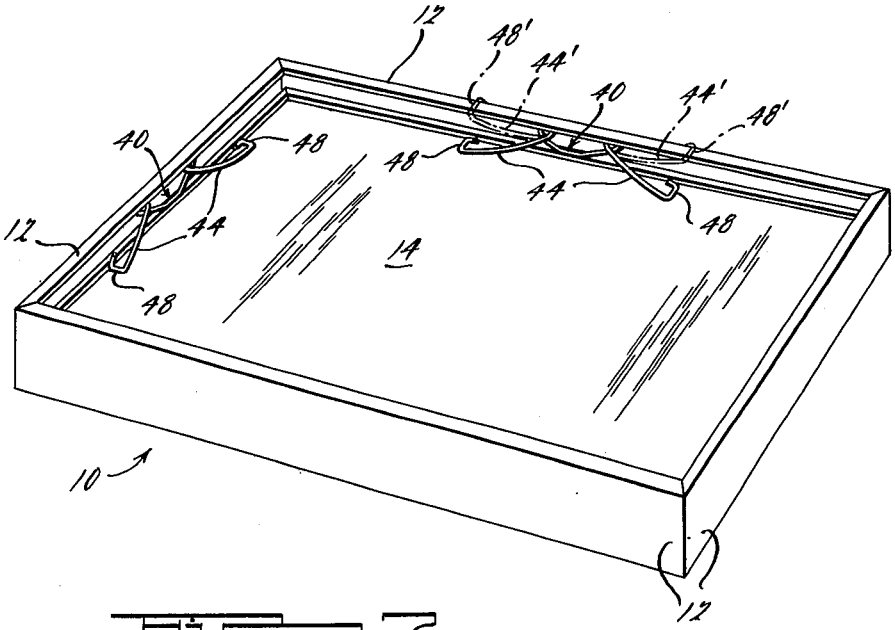
FIG. 7.

ART FRAME

BACKGROUND — SUMMARY OF THE INVENTION

The present invention relates to an improved frame for holding and displaying pictures, photographs, paintings, prints, advertising and promotional materials, signs, and the like. A number of art and picture frames are currently on the market and have been known in the past, but all have drawbacks which the present invention overcome.

The present invention has four frame sections which are cut and mitered to form, when assembled, a generally rectangular frame. The frame sections have a plurality of elongated slots in them and are wide enough to provide sufficient depth to the frame. Spring clips are provided in the corners of the frame to hold adjacent frame sections together. The spring clips allow the frame sections to be assembled without tools and be securely held together. No other means are necessary to hold the frame together. The frame also can be taken apart easily without tools.

Additional brace or support members are also provided in the corners of the frame. They are generally L-shaped, are positioned perpendicular to the spring clips, and provide added support and rigidity for the frame.

The frame is adapted to be backloaded quickly and easily without the use of tools. On the inside of the frame sections, a plurality of spring members each having at least one biased arm are provided. The spring members are fixedly secured in elongated slots in the back of the frame sections and the biased arms are positioned to impinge against display materials in the frame. The biased arms are adapted to be easily lifted from the back of the display materials to permit change of the display materials. The frame does not have to be taken apart to do this and it can be done by hand without the use of any tools. For large frames, a plurality of spring members can be utilized on each of the frame sections. Also, the spring members are positioned on the frame sections such that display materials of substantially varying thicknesses can be held in the frame. The biased arms are adapted to securely hold in place display materials ranging from a single document to a mounted oil painting, relief sculpture, book, or thick group of documents.

Further details, objects and features of the invention will become apparent from the drawings and following description.

BRIEF DESCRIPTION OF THE DRAWINGS

FIG. 1 illustrates an art frame constructed in accordance with the present invention;

FIG. 2 is a cross-sectional view taken along line 2—2 of FIG. 1;

FIG. 3 illustrates a corner support member;

FIG. 4 illustrates a spring clip;

FIG. 5 illustrates a spring member will biased arms for holding display materials in the art frame;

FIG. 6 illustrates the use of the present invention with relatively thin display materials; and FIG. 7 illustrates the use of the present invention with relatively thick display materials.

DESCRIPTION OF THE PREFERRED EMBODIMENT

FIG. 1 illustrates a frame 10 constructed in accordance with the present invention. The frame 10 has four frame sections 12 around the periphery thereof. The cross section of a typical frame section 12 is shown in FIG. 2. The sections 12 are normally assembled in the manner shown in FIG. 1, namely forming a square or rectangular-shaped frame. It is understood that the frame sections 12 can be of any length, although the sections on the opposite sides of the frame 10 should be the same length.

The frame 10 is adapted to hold display materials which are generally indicated by the numeral 14. The display materials 14 can comprise any of the materials normally held in a frame for viewing, such as paintings, photographs, prints, advertising materials, promotional material, posters, signs, and the like, as well as sculptures, books, and other three-dimensional materials. The display materials 14 generally have a piece of clear plastic or glass 16 on the outer surface thereof for protection (FIG. 2). The numeral 18 in FIG. 2 refers to the document, photograph, or the like being displayed. As explained hereinafter, the specific material 18 which can be held in place in the present invention for viewing can be of a wide range of thicknesses. For example, the materials can be as thin as a single document, or as thick or thicker than the materials 18' shown in hidden lines in FIG. 2. Normally, a rigid backing member 20 is positioned in back of the display materials to hold them flat in the frame and tightly against the glass 16.

The ends of the frame sections 12 are mitered at a 45 degree angle so that the sections fit together to form an attractive-looking frame. The sections 12 can be of any material, but preferably are elongated aluminum or plastic extrusions which are formed in substantial lengths and then cut to the desired size. As shown in FIG. 2, the extrusions forming the sections 12 have a plurality of elongated slots 22, 24 and 26 therein for purposes later to be described. In a preferred embodiment, the sections 12 have generally L- or J-shaped cross sections. The display materials 14 are positioned adjacent one end 28 of the sections 12. The opposite end 30 of the sections 12 normally rests against the wall or other surface on which the frame is hung or otherwise secured. The sections 12 also should be sufficient width so that the frame 10 will have sufficient depth to it. The increased width or depth adds to the pleasing and aesthetic nature of the frame 10 and also allows the frame to accommodate display materials of substantially varying thicknesses.

The frame sections are held together at their mitered ends by spring clips 32. One end of the clip 32 is inserted in elongated slot 24 of one of the sections 12 and the other end of the clip 32 is inserted into the corresponding slot 24 in an adjacent section 12. When all of the sections 12 have been assembled together in this manner, they form the rectangular frame 10 shown in FIG. 1. The clips 32 are frictionally secured and locked in place in each of the frame sections 12. The spring clips 32 are made of a bent piece of thin, flat metal and are preferably provided in the shape shown in FIG. 4. The angle formed between the two ends or arms of the clips 32 is less than a right angle, on the order of 75–80°. In this manner, when the clip 32 is positioned between adjacent sections 12 which are required to be substantially perpendicular to each other to form the frame 10, the clip will be biased and tightly secured in place. For added strength and tension, a reinforcing rib 34 is provided at the bend.

With the present invention, the frame sections 12 can be secured together without the use of any tools, screws, or other means. The spring clips 32 can be easily and quickly inserted by hand into the frame sections 12 and the four frame sections 12 can then be assembled together to form the frame 10. The resultant frame 10 is rigid and securely assembled in this manner. Moreover, it is possible to take apart or knock down the frame 10 without the use of any tools. This procedure is essentially the reverse of the manner in which the frame is put together.

A support member 36 is provided in each of the corners of the frame 10 for added strength and rigidity. The support 36 generally comprises an L-shaped brace as shown in FIG. 3. It is positioned between adjacent frame sections 12 when they are assembled together. Preferably, the support member 36 and the spring clip 32 are positioned in the frame sections 12 substantially perpendicular to one another. This relationship is shown in FIG. 2. The member 36 is positioned in elongated slot 26 which is adjacent and perpendicular to slot 24 in which the spring clip 32 is positioned. This provides sufficient rigidity and support for the frame 10 such that it cannot be twisted in any maner and will lie smoothly and evenly against the wal or surface on which it is hung.

The frame 10 is adapted to be back loaded, that is, the display materials 14 are inserted in the frame 10 from the back. The display materials 14 are held in place by a plurality of spring members 40 (FIG. 5). Each spring member 40 preferably consists of a single piece of bent wire. The wire is bent into a pair of small coil springs 42, a pair of bias arms 44 and an intermediate section 46 positioned between the coil springs 42. At the end of each of the bias arms 44, a hooked "foot" 48 is provided.

The members 40 are adapted to be inserted in elongated slot 22 of the frame sections 12. Referring to FIG. 2 for the moment, the coil springs 42 are first inserted in one end 50 of the slot 22 and then the intermediate section 46 is snapped into place over the ridge 52 into the recess 54 in the opposite end of the slot 22. In this manner, the spring members 40 are securely situated in place in the frame 10. Also, the coil springs 42 are positioned within the frame sections 12 and cannot interfere with the loading or unloading of the display materials 14.

The manner in which the spring members 40 are positioned on the frame 10 is also shown in FIGS. 6 and 7. The members 40 are positioned in the sections 12 such that the biased arms 44 extend downwardly toward the back of the display materials 14. The biased arms 44 have sufficient length and the spring members 40 have sufficient resiliency and strength such that the biased arms 44 impinge snugly on the back of the display materials 14 and securely hold them in place. The hooks 48 on the arms 44 provide sufficient area and support to hold the arms 44 firmly in position on the display materials 14. Although it is possible in accordance with the invention to have either one or two arms 44 on each of the spring members 40, preferably two arms 44 are provided. This provides a more even pressure distribution on the display materials 14 tending to hold them more evenly in place in the frame 10.

In accordance with the present invention, the display materials 14 can be easily and quickly inserted into and removed from the frame 10. Thus, little time or effort is required to change the display materials and the present invention is particularly suitable for businesses where the display materials are changed frequently. Also, the display materials can be essentially of any thickness from a single document to materials extending up to the level of the spring members 42 in the frame sections 12. It is thus unnecessary to provide different frames for different sizes and thicknesses of display materials.

Moreover, the display materials 14 can be inserted and removed from the frame 10 without the use of any tools or removal of any screws or other parts of the frame. Referring specifically to FIGS. 6 and 7, it is only necessary to lift up the biased arms 44 and rest the hooked feet 48 on the upper surface 30 of the frame sections 12. This is shown in dashed lines and indicated by numerals 44' and 48' in FIGS. 6 and 7. Once all of the arms 44 of the spring members 40 included with the frame 10 are lifted up and positioned in that manner, the display materials 14 can be easily inserted and removed. After the display materials are inserted in the frame 10, the arms 44 are returned to their normal position resting on the back of the display materials 14.

FIGS. 6 and 7 illustrate the ability of the present invention to accomodate display materials of substantially varying thicknesses. FIG. 6 illustrates the use of the present invention with relatively thin display materials and shows the manner in which the spring members 40 and the biased arms 44 are utilized. FIG. 7 illustrates the same frame with substantially thicker display materials 14 positioned therein.

For larger or elongated frames utilizing the present invention, two or more spring members 40 can be positioned on each of the frame sections 12. This provides more holding tension for the display materials 14.

It is to be understood that the foregoing description describes preferred embodiments of the invention. Various changes and modifications may be made without departing from the spirit and scope of the invention as defined by the appended claims.

I claim:

1. An art frame for holding and displaying materials of substantially varying thicknesses, said frame having a plurality of corners and comprising a plurality of frame sections forming a polygonal-shaped frame, each of said frame sections having a plurality of elongated channels formed therein, frictional locking means positioned in each of said corners and adapted to securely hold two adjacent frame sections together, said frictional locking means being inserted in a first of said elongated channels in each of two adjacent frame sections, brace means in each of said corners, said brace means being positioned in a second of said elongated channels in each of two adjacent frame sections, said first elongated channel and said elongated channel in each frame section being substantially perpendicular to each other, and a plurality of spring members each comprising a body and at least one biased member extending therefrom, said body lying in a third of said elongated channels and said biased member being biased in a direction to securely hold said materials in place regardless of the thickness thereof, said third elongated channel in each of said frame sections being in a plane substantially vertical to the plane of the display materials, said biased member having a hooked portion at its outer end, said biased member and hooked portion being movable from a first position where said hooked portion is resting on said display materials holding them in place to a second position where said hooked portion is positioned on one of said frame sections allowing said materials to be inserted and removed from said frame.

2. The frame as set forth in claim 1 wherein said spring members have two biased members.

3. The frame as set forth in claim 1 wherein said frictional locking means comprises a generally V-shaped spring clip.

4. The frame as set forth in claim 1 wherein said brace means comprises a generally L-shaped member.

5. The frame as set forth in claim 1 wherein said spring members are positioned on the inside of said art frame and do not project from the rear face thereof, whereby said art frame is adapted to lay flat against a surface on which it is mounted.

6. The frame as set forth in claim 1 wherein two of said spring members are provided in said frame, said spring members being positioned in frame sections substantially opposite to each other in order to provide a balanced force holding said display materials in place.

7. An art frame for holding and displaying materials of substantially varying thicknesses, said frame having a plurality of corners and comprising a plurality of frame sections forming a polygonal-shaped frame, each of said sections having a plurality of elongated channels formed therein, locking means positioned in each of said corners and adapted to securely hold two adjacent frame sections together, said locking means being inserted in a first of said elongated channels in each of two adjacent frame sections, and a plurality of spring members each comprising a body and at least one biased member extending therefrom, said body lying in a second of said elongated channels and said biased member being biased in a direction to securely hold said materials in place regardless of the thickness thereof, said second elongated channel in each of said frame sections being in a plane substantially vertical to the plane of the display materials, said biased member having a hooked portion at its outer end, said biased member and hooked portion being movable from a first position where said hooked position is resting on said display materials holding them in place to a second position where said hooked portion is positioned on one of said frame sections allowing said materials to be inserted and removed from said frame.

8. The frame as set forth in claim 7 wherein said spring members have two biased members.

9. The frame as set forth in claim 7 wherein said locking means comprises a generally V-shaped spring clip and is secured by friction in said first elongated channels.

10. The frame as set forth in claim 7 further comprising brace means in each of said corners, said brace means being positioned in a third of said elongated channels in each of two adjacent frame sections.

11. The frame as set forth in claim 10 wherein said first elongated channel and said third elongated channel in each frame section are substantially perpendicular to each other.

12. The frame as set forth in claim 7 wherein said spring members are positioned on the inside of said art frame and do not project from the rear face thereof, whereby said art frame is adapted to lay flat against a surface on which it is mounted.

13. The frame as set forth in claim 7 wherein two of said spring members are provided in said frame, said spring members being positioned in frame sections substantially opposite to each other in order to provide a balanced force holding said display materials in place.

* * * * *

UNITED STATES PATENT AND TRADEMARK OFFICE

CERTIFICATE OF CORRECTION

PATENT NO. : 4,041,632

DATED : August 30, 1977

INVENTOR(S) : Robert Sarkisian

It is certified that error appears in the above-identified patent and that said Letters Patent are hereby corrected as shown below:

Column 1, line 63, "will" should be --with--. Column 2, line 19, "material" should be --materials--. Column 3, line 27, "maner" should be --manner--. Column 3, line 28, "wal" should be --wall-- Column 4, line 57 (Claim 1), after latter "said" insert --second--. Column 6, line 10 (Claim 7), "position" should be --portion--.

Signed and Sealed this

*Fifteenth* Day of *November 1977*

[SEAL]

*Attest:*

RUTH C. MASON
*Attesting Officer*

LUTRELLE F. PARKER
*Acting Commissioner of Patents and Trademarks*